United States Patent [19]

Schick

[11] 4,091,269

[45] May 23, 1978

[54] SENSING DEVICE FOR COUNTING WORKPIECES TRANSPORTED IN STEPPED FORMATION

[76] Inventor: Günther Schick, Am Herrenkamp 10, 4800 Bielefeld, Germany

[21] Appl. No.: 658,499

[22] Filed: Feb. 17, 1976

[51] Int. Cl.[2] ..... B31B 1/96; G06M 7/10

[52] U.S. Cl. ..... 235/98 B; 93/93 C

[58] Field of Search ..... 235/98 R, 98 A, 98 B; 93/93 C

[56] References Cited

U.S. PATENT DOCUMENTS

| | | | |
|---|---|---|---|
| 3,317,131 | 5/1967 | Walsh | 235/98 B |
| 3,667,672 | 6/1972 | Kennedy et al. | 235/98 B |
| 3,702,925 | 11/1972 | Anderson et al. | 235/98 R |

*Primary Examiner*—Stanley J. Witkowski

*Attorney, Agent, or Firm*—Ernest F. Marmorek

[57] ABSTRACT

In a counting arrangement for articles such as single or multilayer paper sheets having greatly varying thicknesses, a sensing device is arranged between the loading rollers bearing on the surface of the article stream delivered in overlapping fashion and operable to be carried along by the edge presented by each article for a predetermined distance and to become gradually retrieved from the edge and returned to its initial position in engagement with a contact of a counter thereby delivering a pulse to the counter.

5 Claims, 2 Drawing Figures

SENSING DEVICE FOR COUNTING WORKPIECES TRANSPORTED IN STEPPED FORMATION

FIELD OF THE INVENTION

The present invention relates generally to a delivery apparatus for the sheet-by-sheet delivery of various articles of manufacture such as plate-like-cuts from sheet metal, cardboard or corrugated board, paper sheets, folded paper articles, newspapers, periodicals, notebooks, paper bags or paper sacks and, more particularly, it relates to a novel counting apparatus for such articles delivered at high speed in an overlapping fashion.

BACKGROUND OF THE INVENTION

The above-noted articles during their manufacture and also during their further processing must be counted several times. Such counting is easy to perform when such products follow each other in the direction of the delivery with a gap between the adjacent articles, as in such case the counting process may employ a mechanical or electrical sensing device which notes the passing of an article or the absence of it with a "yes" or a "no" pulse, respectively. In the event it is desired at low delivery speed to increase the the number of the delivered articles, then the possibility of stepped or overlapping delivery of the articles can be considered. In the last-mentioned delivery type, however, the counting becomes in most cases considerably difficult. It will not suffice any more a simple "yes" or "no" sensing inasmuch as the gap between the adjacent articles will not be present any more and there will be need to obtain some information as to the fact that an article has passed the counting station and also such information must be made available for the eventual counting itself. Under this condition the jump-like change in the thickness from one article to the other can be considered as a possibility to perform the counting. Such a thickness measuring when the article passes at the measuring station will result in a jump-like indication of the variation which can be used for the counting. In the event one is dealing with thick products then such method appears to be satisfactory. For thin products, especially elastic cuts or paper layers, newspapers, periodicals or notebooks which come in layers and in the case of paper bags or paper sacks, a simple thickness measuring will not suffice or lead to a reliable counting inasmuch as the total thickness of the material which is being delivered in a stepped or overlapping fashion to the measuring station will vary frequently by more than the thickness of an article itself. Therefore the change of the total thickness can not be considered for a reliable counting.

It has been realized that the steps appearing on the upper surface of the stream of articles being delivered in overlapping fashion could be used for the counting and several methods have been proposed and used.

For example, there is a known counting and a sensing arrangement which senses only the height of the step from one to the adjacent article during delivery and employs it for the counting. This operating method has its disadvantage in that the height of the step is relatively small and in order to operate a switching element corresponding large amplification becomes necessary and the small step must be translated into a relatively large operating path. Such condition requires very sensitive mechanical translating elements having a very small play and during the rapid actuation, these become very susceptible to operational defects and, at the same time, under certain conditions they must be set for the height of the jump in the steps. Inaccurate setting in such devices will lead to errors in the counting. In the event of products or articles, such as bags or sacks or thin newspapers, the use of the above devices is totally prohibitive and the result obtained with them, if used, are unsatisfactory. During their operation, the fact that within one article there can be several thicknesses present, such as is the case with bags or sacks having a glued-in bottom in the form of a block or plate bottom, will contribute to additional errors in the counting. Also, in the case of newspapers having several layers, it can be the case that an insert might slip out of its normal position within the article and it can form a more or less defined step despite the fact that the top layer of the newspaper is a single layer. Further defects can be caused by other circumstances, such as when the measuring or sensing station is not pressed or loaded down.

This known operating method further requires that the sensing head itself is not oriented within the sensing station onto the total thickness of the articles passing through in an overlapping stream. It is oriented at a certain distance beyond or ahead of the measuring station so that it can sense the step formed by the articles. This will lead also to further errors in the counting.

The above-noted sensing arrangements are generally characterized by the disadvantage of having short sensing distances and their additional counting errors due to the various thicknesses present in the articles of one product. Therefore, for these arrangements a reliable counting is prohibited.

SUMMARY OF THE INVENTION

It is, therefore, an object of the present invention to provide a counting arrangement for the above-noted articles delivered at high speeds in overlapping fashion which arrangement will eliminate the above-noted disadvantages associated with the prior art apparatus.

It is another object of the present invention to provide a counting arrangement of the above-noted art which is capable of performing a reliable counting of articles delivered to the measuring station in an overlapping fashion irrespective of the thickness of the articles and, at the same time, eliminate the above-noted disadvantages of the prior art devices.

It has been recognized according to the present invention that the measuring of the height of the step of the articles delivered in overlapping fashion will not lead to a satisfactory result, as has been discussed in connection with the prior art devices employing such method. It has been also recognized that there is need for a sensing arrangement which orients itself upon the upper surface of the articles delivered in an overlapping fashion and which should itself present a loading at the measuring or sensing station but should not produce a loading effect before or after the measuring station in the delivery direction. Contrary to the case in the above-noted prior art arrangements which lead to the above-noted defects.

According to the present invention, the sensing arrangement will exert a load upon the measuring station itself, that is, it will press upon the streaming flow of the overlapping articles in such a fashion that it will cooperate with a loading surface, such as a loading roller, pressing on the upper surface. From such loading roller there is provided a protruding portion which, according to the present invention, will sense not the thickness of the step but will engage and hang on to the step presented by the article, no matter how small such step might be, and it becomes carried with such step to a certain distance in the delivery direction until it is, according to the mounting arrangement of the present invention, disengaged or retrieved from the step and withdraws beyond the contour of the cylindrical surface of the loading roller itself and, as a result, even in the case of very thin products it will pass over a elatively large path which then can reliably be used to operate a switching means. In the event the upper surface of the article presents a closed surface then any steps appearing therein cannot be sensed by the arrangement according to the present invention as a clear step. It will remain ineffective for the nose portion of the arrangement inasmuch as such a nose portion, according to the present invention, is spring biased in the radial direction with respect to the loading roller or generally vertically with respect to the loaded surface. In other words, a bump presses the protruding position upward but does not carry it with it, which upward motion cannot actuate the switching means. As a result, a setting with respect to the height of the step will not be necessary and thin or thick articles can be equally reliably counted when delivered in an overlapping fashion due to the fact that the catching of the sensing protrusion by the steps appearing in the stream of the articles will cause a carrying of the protruding portion and the associated parts for a relatively long path with their subsequent disengaging thereafter. Therefore, a simple "yes" - "no" type control for the counting apparatus will operate satisfactorily.

BRIEF DESCRIPTION OF THE DRAWING

The present invention will become more readily apparent from the following description of a preferred embodiment thereof shown, by way of example, in the accompanying drawing, in which.

DESCRIPTION OF THE PREFERRED EMBODIMENT

Figure 1:
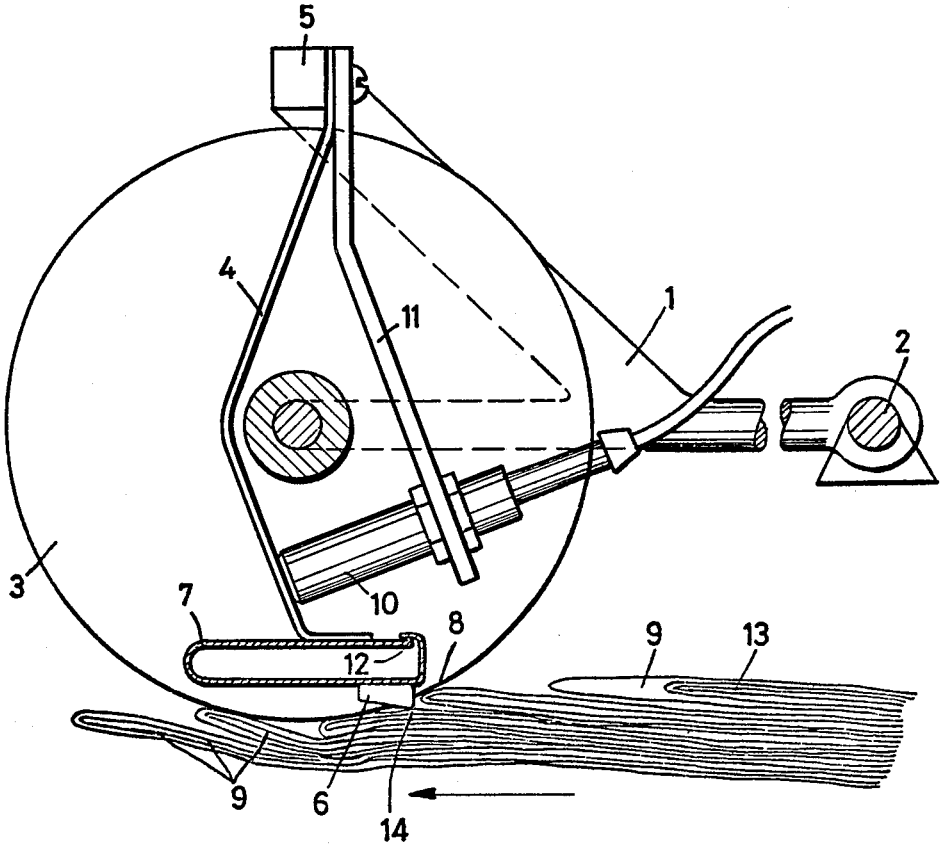
FIG. 1 illustrates in a schematic fashion the sensing device according to the present invention in its operative relationship with a pair of adjacent loading rollers one of which being omitted from the drawing for sake of clarity of the illustration.
Figure 2:
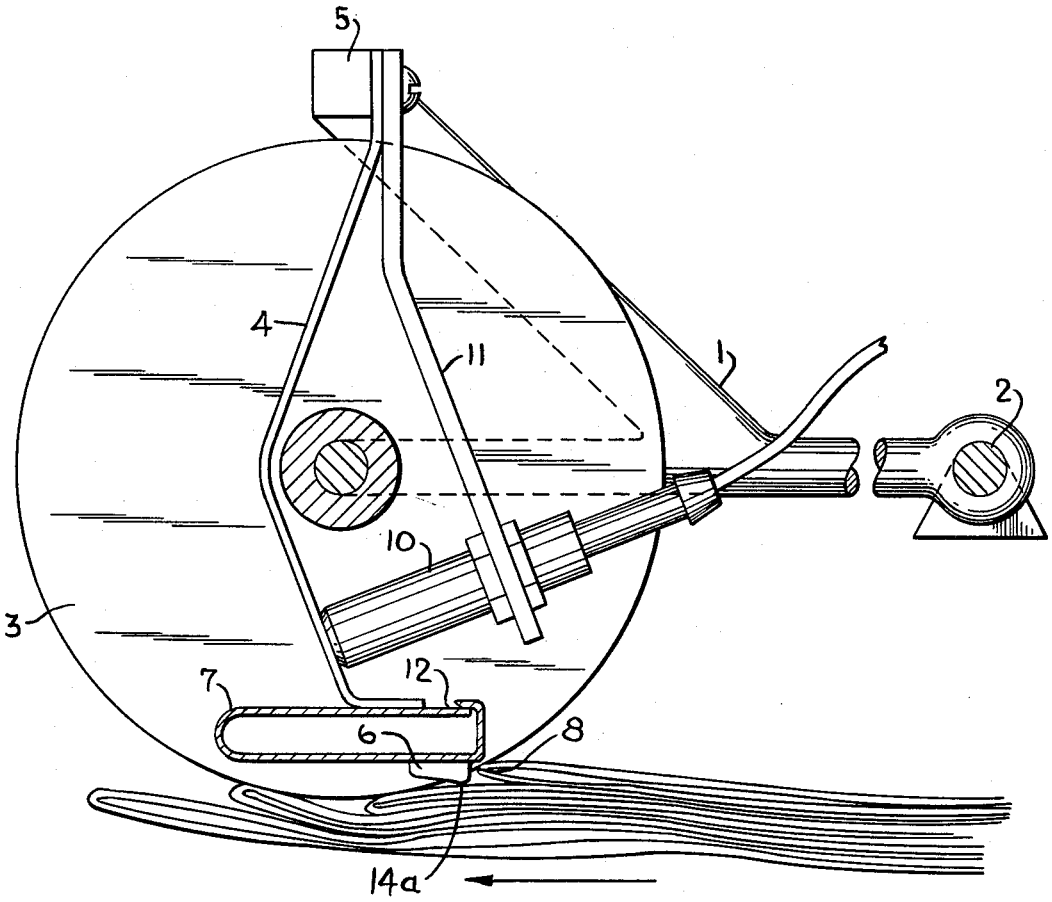
FIG. 2 is a fragmentary view of a portion of FIG. 1, showing an embodiment wherein the sensing means' protruding portion is slightly rounded.

With reference to the FIG. 1, the sensing arrangement in the illustrative embodiment includes a support means such as a lever arm 1 which is rotatably mounted on an axle 2 at one end thereof and at the other end it rotatably carries roller means such as a pair of similarly sized loading rollers 3 which load the upper surface of the articles passing underneath in a known manner. Between the loading rollers 3, of which only one is shown, the other being omitted for clarity of illustration, the lever arm 1 carries the sensing arrangement according to the present invention which includes a supporting arm 4 made from a resilient spring-like material and which at one end is fixedly connected to a support 5 while at the other end it carries a spring bracket 7 having a sensing means such as protruding portion 6 made from strip metal in a width of $\approx \frac{1}{4}$ inch mounted thereon. As mentioned above, the spring-like supporting arm 4 permits the carrying of the protruding portion 6 by a front edge 8 of the steps in the article stream delivered in an overlapping fashion, as they pass under the loading rollers 3. It is illustrated as a stream of folded papers 9, such as newspapers. The protruding portion 6 is carried along by the edge 8 of an article in the delivery direction to a certain extent, but due to the mounting of the protruding portion 6 on the bracket 7 and to the guiding of the bracket 7 on the arm 4, the arrangement is such that the protruding portion 6 will protrude less and less out of the contour of the roller 3 as it is being further carried by the edge 8 in the delivery direction indicated by the arrow. After the protruding portion 6 has been carried a few millimeters on an accurate path, it will completely withdraw behind the general contour of the loading rollers 3 so that it will disengage the edge 8 and it will return through the spring action of the arm 4 into its initial position into abutting relationship with the inductive switching means 10 over which an electric pulse becomes delivered to a counting arrangement, not shown, and which can be any well-known counting arrangement responsive to an electric pulse delivered upon the closing or opening of a contact. The switch 10 is fixedly mounted in a bracket 11 which, in turn, is fixedly connected to the support 5. The spring bracket 7 itself is constructed in such a manner that a radial deflection of the protruding portion 6 is permitted in case it runs over bumps as above noted but at the same time it defines the maximum protrusion of the portion 6 over the radius of the loading rollers 3. This is due to the arrangement that the end of the bracket 7 carrying the protruding portion 6 loosely overlaps the other end of the bracket 7. This construction permits the deflection of the protruding portion 6, and as above described, it will, however, prevent the protruding portion 6 to be carried in the delivery direction by an unevenness in the surface which might be caused by various thicknesses within one article, such as the slipping of an insert 13 out of its normal position within the folded article 9 or in the case when various thicknesses are present in a single article, or in the case of a bag or sack having a block bottom, as mentioned above. The protruding portion 6 will remain engaged and will be carried on its opening path only by articles having a definite sharp edged step; therefore, the counting will be reliable. It follows from the above that the height of the steps in the delivered stream of the articles will not have any significance on the operation of the sensing device according to the present invention. It is the construction of the front edge of the end portion 14 which plays a definite role and it is constructed according to the invention with a well-defined sharp edge. As can be seen in the figure, the front edge of the end portion 14 points downward substantially vertically for meeting the edge articles. For certain uses, as would be obvious to a person of ordinary skill in the art, the end portion 14 may be more or less slightly rounded as shown at **14*a* in FIG. 2**.

The sensing arrangement according to the present invention will be adapted for counting at very high counting speeds and will function reliably even at 1500 articles per minute for single paper sheets or with papers having a thickness of about 10 mm without requiring any adjusting or resetting between product runs having such diverse thicknesses.

I wish it to be understood that I do not desire to be limited to the exact details of construction shown and described, for obvious modifications will occur to a person skilled in the art.

Having thus described the invention, what I claim as new and desire to be secured by Letters Patents, is as follows:

1. In an apparatus for counting a stream of articles delivered in an overlapping fashion, the combination comprising:

support means;

roller means rotatably mounted on said support means, to be operable to ride on and bear down on the surface of the delivered articles;

a resilient arm means mounted on said support means;

sensing means resiliently supported by said resilient arm means and protruding into the path of said articles for engagement with an edge portion of each of said articles and operable to be moved against the resilient support force of the resilient arm means by said edge portion for a predetermined distance and then disengaged and returned by the resilient support force of the resilient arm means, to its initial position; and contact means arranged in the path of said resilient arm means and operable to be contacted by said resilient arm means when said sensing means returns to its initial position with respect to the contact means, for counting said articles.

2. The combination as claimed in claim 1, wherein a spring bracket means is mounted on said resilient arm means and said sensing means includes a protruding portion mounted on said spring bracket means, said spring bracket means biasing said protruding portion into engagement with said edge portion of said article in the radial direction, said spring bracket means having a rest position and having an end portion defining the extent of protrusion of said protruding portion beyond the contour of said roller means and operable to retrieve resiliently said protruding portion out of the path of said article into the radial extent of said roller means when said end portion is not in its rest position.

3. The combination as claimed in claim 1, wherein said sensing means includes a protruding portion having a substantially vertical front portion having a sharp front edge for engagement with the step formed by individual articles within the stream of said articles.

4. The combination as claimed in claim 1, wherein said contact means comprises a switch means operable for producing an electrical pulse signal when said sensing means returns to its initial position.

5. The combination as claimed in claim 1, wherein said sensing means includes a protruding portion having a substantially vertical front portion and slightly rounded front edge for engagement with the step formed by individual articles within the stream of said articles.

* * * * *